US008282179B2

(12) United States Patent
Haraguchi

(10) Patent No.: US 8,282,179 B2
(45) Date of Patent: Oct. 9, 2012

(54) IMAGE RECORDING APPARATUS

(75) Inventor: Masafumi Haraguchi, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 438 days.

(21) Appl. No.: 12/501,605

(22) Filed: Jul. 13, 2009

(65) Prior Publication Data

US 2010/0013877 A1 Jan. 21, 2010

(30) Foreign Application Priority Data

Jul. 18, 2008 (JP) ..... 2008-187351

(51) Int. Cl.
*B41J 25/308* (2006.01)
*B41J 3/00* (2006.01)

(52) U.S. Cl. ..... 347/8; 347/4

(58) Field of Classification Search ..... 347/8, 101, 347/104–106, 4
See application file for complete search history.

(56) References Cited

U.S. PATENT DOCUMENTS

| | | | | |
|---|---|---|---|---|
| 7,549,714 | B2 * | 6/2009 | Samoto | 347/8 |
| 2001/0038401 | A1 * | 11/2001 | Kawase et al. | 347/42 |
| 2006/0170751 | A1 * | 8/2006 | Yokoyama et al. | 347/104 |
| 2007/0103529 | A1 * | 5/2007 | Pearl et al. | 347/101 |

FOREIGN PATENT DOCUMENTS

JP 2005-14334 A 1/2005

* cited by examiner

*Primary Examiner* — Jason Uhlenhake
(74) *Attorney, Agent, or Firm* — Holtz, Holtz, Goodman & Chick, PC

(57) ABSTRACT

An image recording apparatus is provided with the following a conveying section including a platen which conveys a recording medium, an image recording section which performs image recording with respect to the recording medium conveyed by the conveying section, and a moving mechanism which moves at least one of the image recording section and the conveying section and enables a movement between a recording position in which the image recording is performed and a non-recording position in which the image recording is not performed, and a positioning section which permits the space between the image recording section and the conveying section to have a predetermined value at the recording position. The point of application of a force with which at least one of the image recording section and the conveying section is moved by the moving mechanism is substantially coincident with the positioning section.

7 Claims, 9 Drawing Sheets

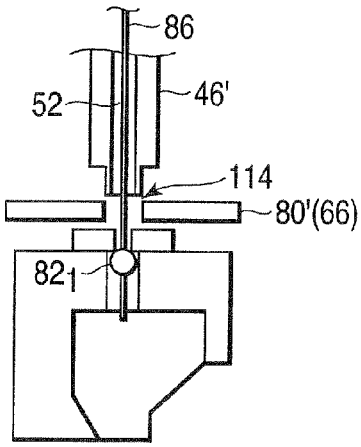
FIG. 10
FIG. 11A
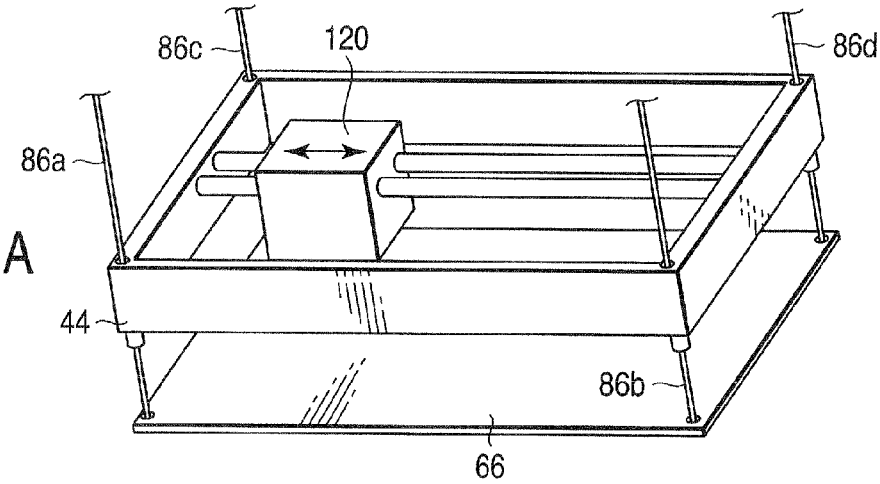
FIG. 11B
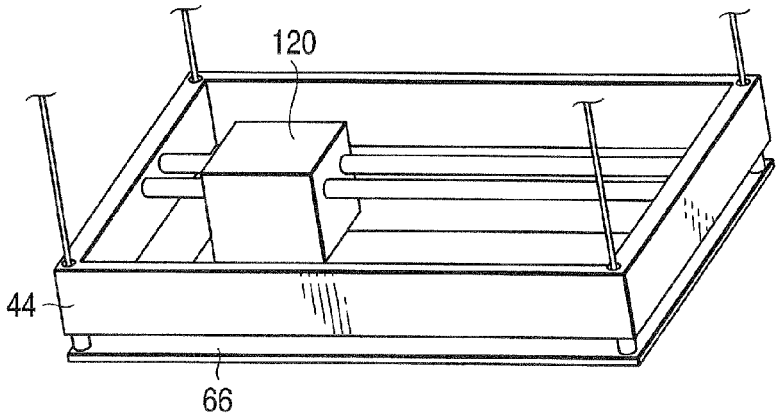

IMAGE RECORDING APPARATUS

CROSS-REFERENCE TO RELATED APPLICATIONS

This application is based upon and claims the benefit of priority from prior Japanese Patent Application No. 2008-187351, filed Jul. 18, 2008, the entire contents of which are incorporated herein by reference.

BACKGROUND OF THE INVENTION

1. Field of the Invention

The present invention relates to an image recording apparatus in which the space between a recording section and conveying section is adjustable.

2. Description of the Related Art

In recent years, inkjet printers have become widely used on account of their low recording noise and high print quality, in general. In these inkjet printers, the distance between a recording head that ejects ink and a conveying section for conveying a recording medium is set to a predetermined value for high-quality image recording.

In an image recording apparatus described in Jpn. Pat. Appln. KOKAI Publication No. 2005-14334, for example, a platen is raised by a platen moving mechanism to a position in which image recording can be performed, and a positioning hole in the platen is caused to engage with the a positioning lug on a support portion that supports a recording head. Thus, a distance from a recording medium supported on the platen to a nozzle surface of the recording head is adjusted to a predetermined value, whereby high-quality image recording can be performed.

BRIEF SUMMARY OF THE INVENTION

Accordingly, an object of the present invention is to provide an image recording apparatus, capable of performing high-quality image recording without causing deformation of any components by the moving force of a moving mechanism, in adjusting a space between a recording section and conveying section by contact with space adjustment members.

According to an aspect of the invention, there is provided an image recording apparatus, which comprises a conveying section including a platen which conveys a recording medium, an image recording section which ejects an ink onto the recording medium conveyed by the conveying section, thereby performing image recording, a moving mechanism which moves at least, one of the image recording section and the conveying section to change the space between the image recording section and the conveying section, and enables a movement between a recording position in which the image recording is performed and a non-recording position in which the image recording is not performed, a positioning section which permits the space between the image recording section and the conveying section to have a predetermined value at the recording position, wherein a point of application of a force with which at least one of the image recording section and the conveying section is moved by the moving mechanism is substantially coincident with the positioning section.

According to another aspect of the invention, there is provided an image recording apparatus, which comprises a conveying section including a platen which conveys a recording medium, an image recording section including a line-type head unit which ejects an ink onto the recording medium conveyed by the conveying section, thereby performing image recording, and a head holding section which holds the head unit, a moving mechanism which moves at least one of the image recording section and the conveying section to change the space between the image recording section and the conveying section, and enables a movement between a recording position in which the image recording is performed and a non-recording position in which the image recording is not performed, a positioning section including (i) a space adjustment member which is provided for one of the head holding section and the platen and adjusts the space between the image recording section and the conveying section, and (ii) an contacting portion which is provided for a remaining one of the head holding section and the platen and permits the space between the image recording section and the conveying section to have a predetermined value at the recording position, wherein a point of application of a force with which the moving mechanism is operated to cause the contacting portion to contact or be fitted with the space adjustment member is substantially coincident, with a spot where the contacting portion contacts or is fitted with the space adjusting member.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 1A and 1B show a configuration of an image recording apparatus according to one embodiment of the invention, in which FIG. 1A is a schematic side view showing the apparatus in a recording position, and FIG. 1B is a schematic side view showing the apparatus in a non-recording position;

FIGS. 6A and 6B show the structure of the conveying section, in which FIG. 6A is a top view, and FIG. 6B is a side view;

FIG. 10 is a view showing a second modification of the one embodiment of the invention;

FIGS. 11A and 11B are views showing a third modification of the one embodiment of the invention.

DETAILED DESCRIPTION OF THE INVENTION

Embodiments of the present invention will now be described with reference to the accompanying drawings.

First, one embodiment of the invention will be described with reference to FIGS. 1A to 8.

Figure 1A:
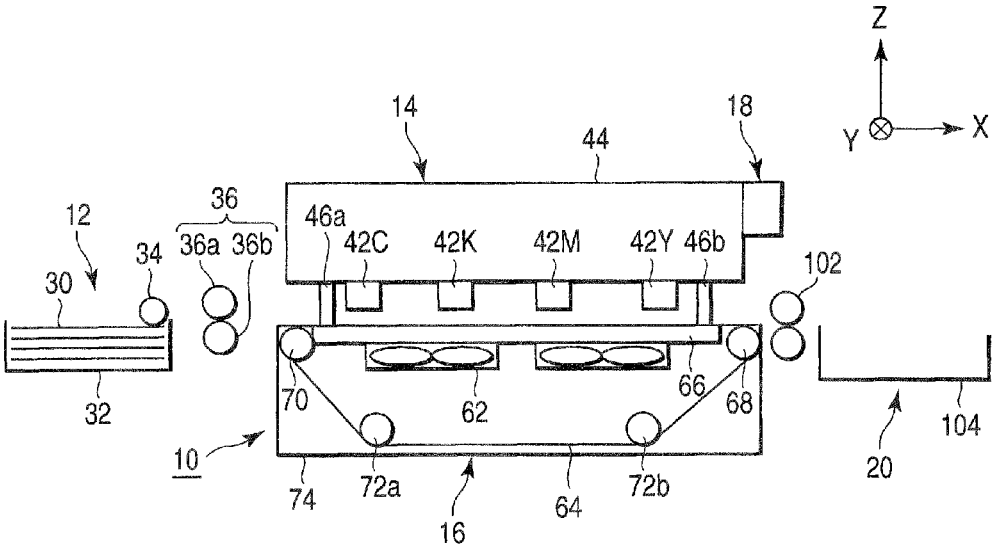
Figure 1B:
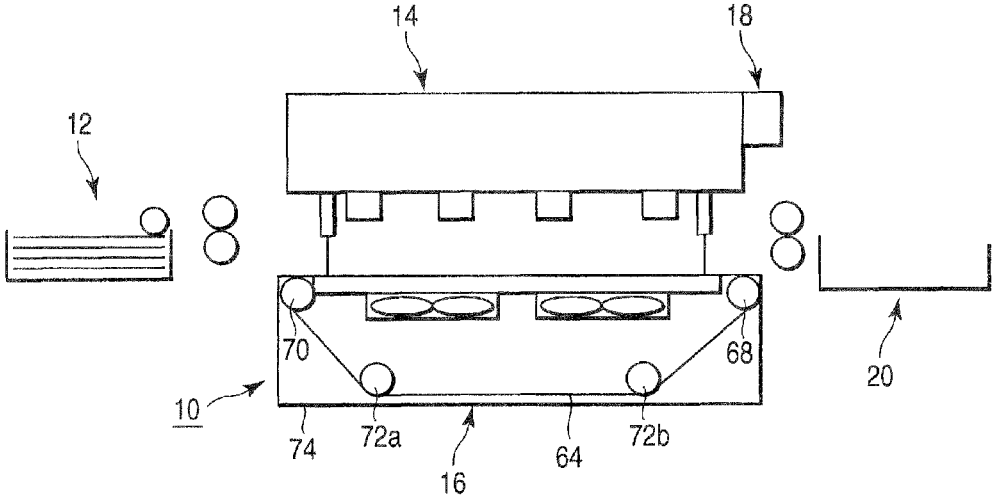
Figure 2:
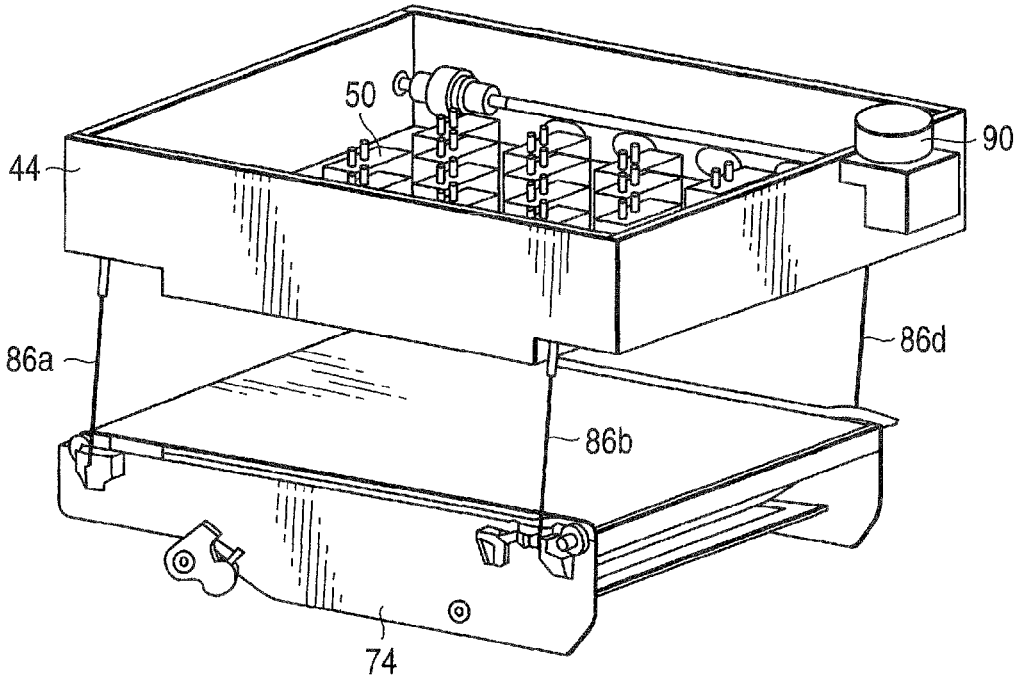
FIG. 2 is a perspective view showing the structures of an image recording section and conveying section shown in FIGS. 1A and 1B.
Figure 3:
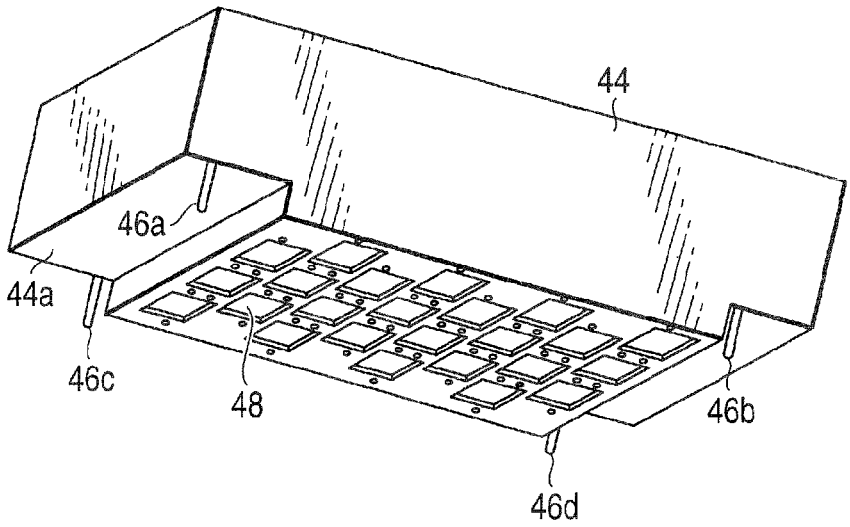
FIG. 3 is a perspective view showing the structure of a head holding member.
Figure 4:
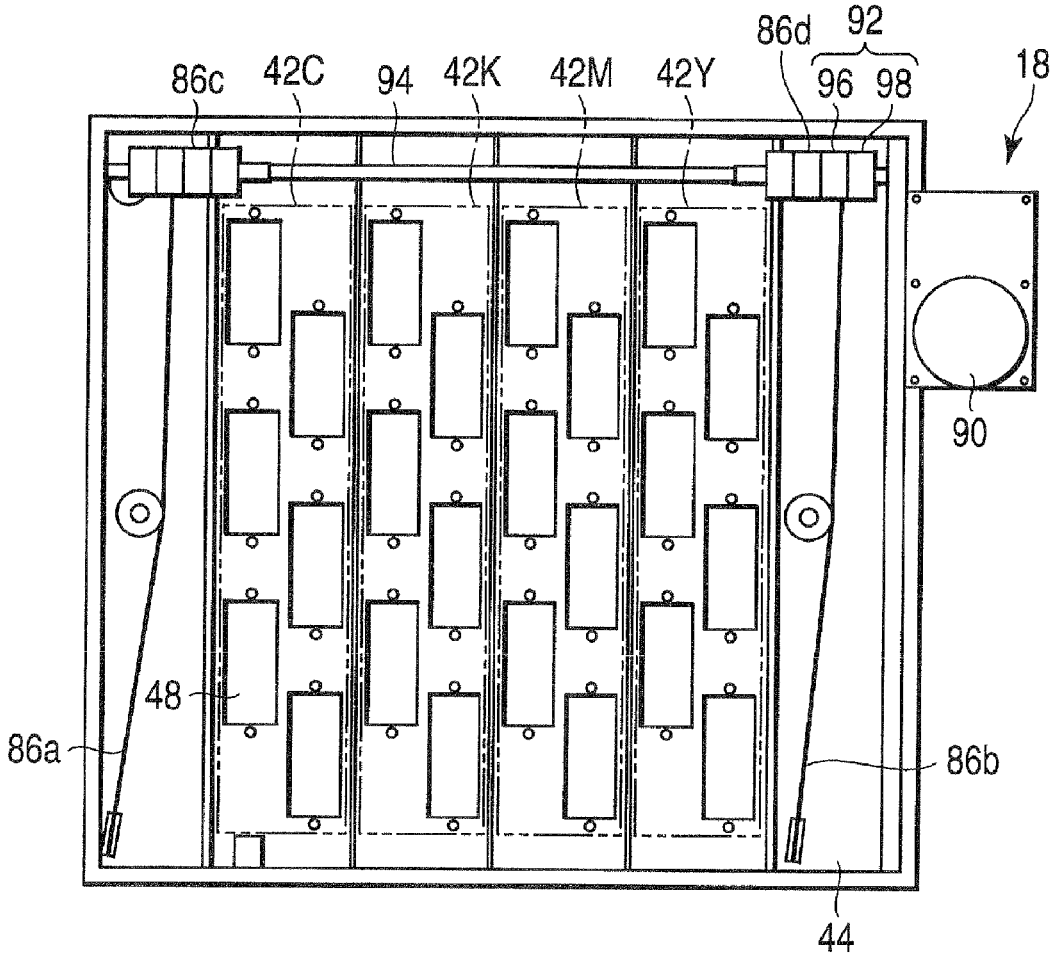
FIG. 4 is a view showing the head holding member and an elevating section.
Figure 5:
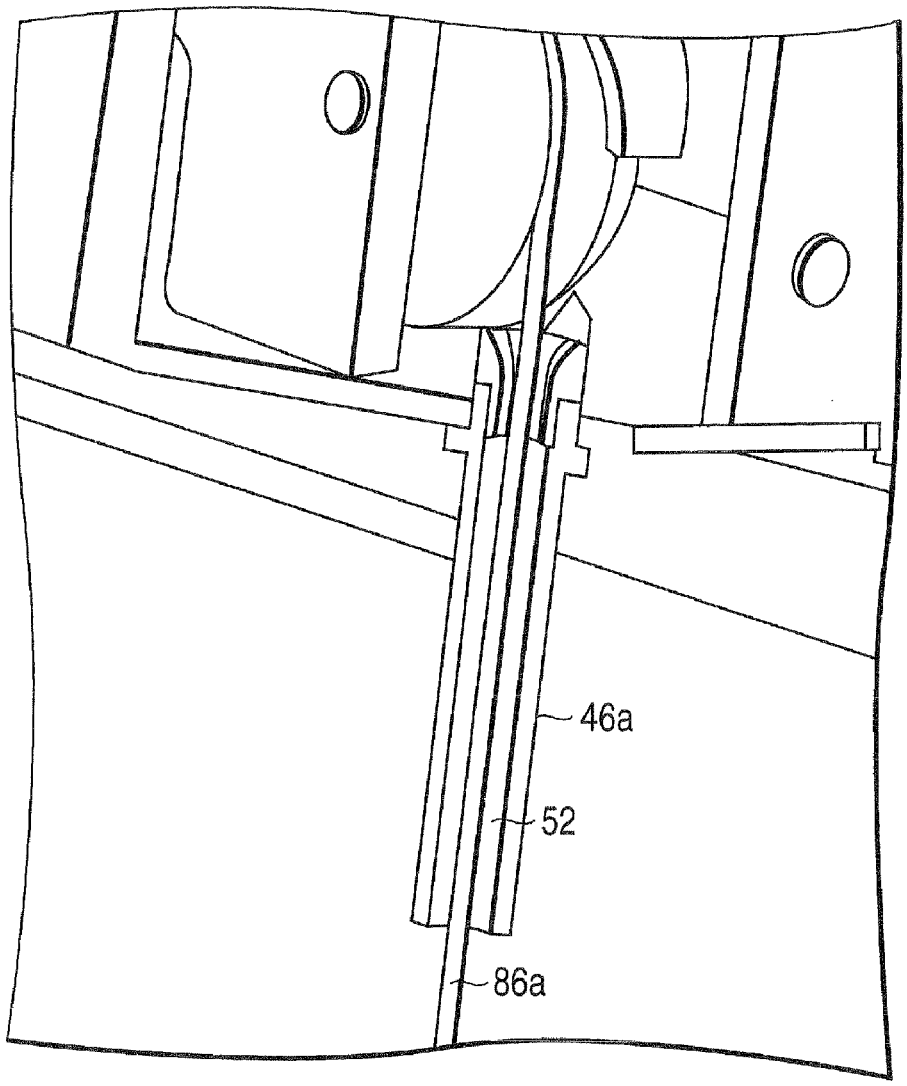
FIG. 5 is an enlarged view showing details of a wire passing through a space adjustment member.
Figure 6A:
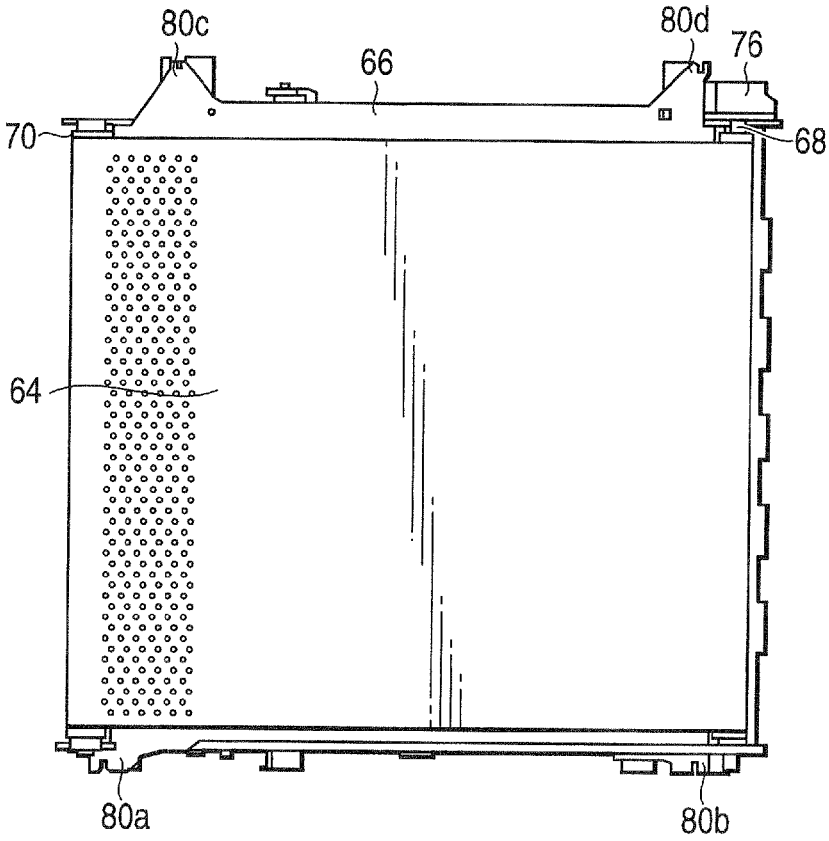
Figure 6B:
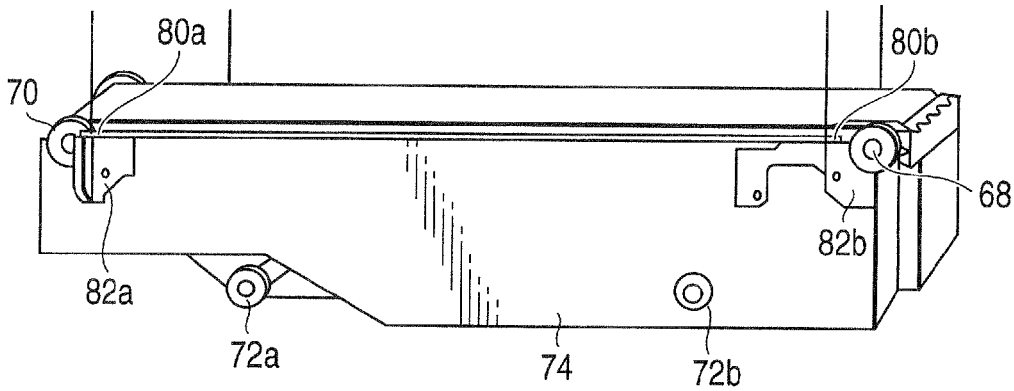
Figure 7A:
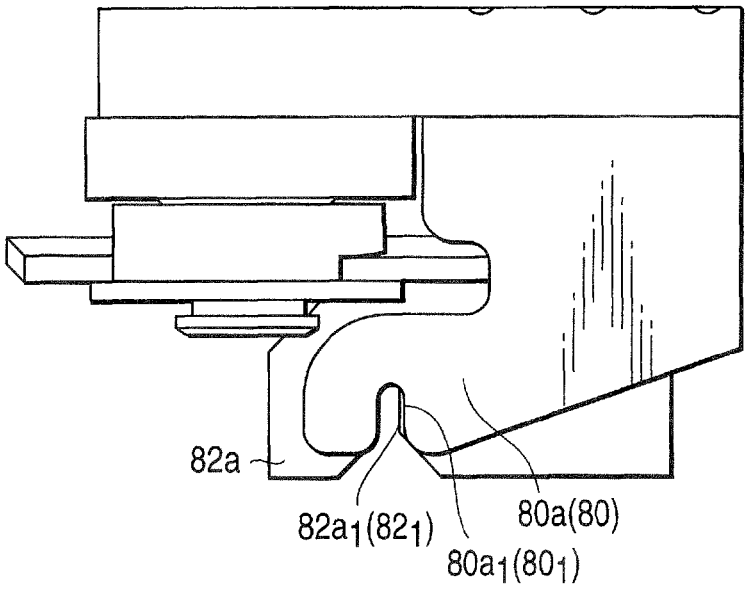
FIG. 7A is an enlarged view showing surroundings of an contacting portion shown in FIG. 6A.
Figure 7B:
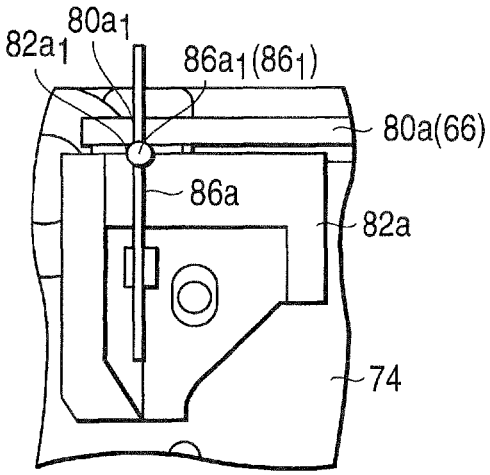
FIG. 7B is a side view corresponding to FIG. 7A.
Figure 8:
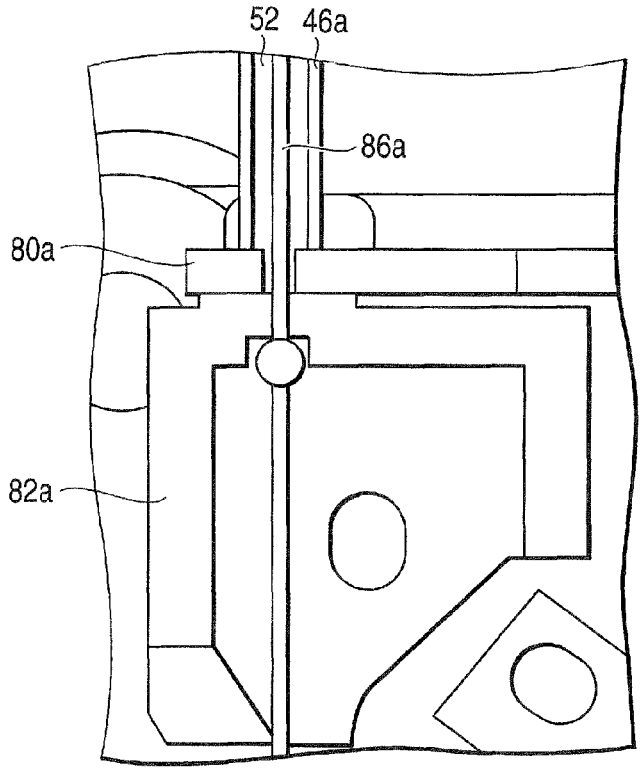
FIG. 8 is a view illustrating how the contacting portion abuts the space adjustment member.

FIGS. 1A and 1B show a configuration of an image recording apparatus according to the one embodiment of the invention, in which FIG. 1A is a schematic side view showing the apparatus in a recording position, and FIG. 1B is a schematic side view showing the apparatus in a non-recording position. FIG. 2 is a perspective view showing the structures of an image recording section and conveying section. FIG. 3 is a perspective view showing the structure of a head holding member. FIG. 4 is a view showing the head holding member and an elevating section. FIG. 5 is an enlarged view showing details of a wire passing through a space adjustment member. FIGS. 6A and 6B show the structure of the conveying section, in which FIG. 6A is a top view, and FIG. 6B is a side view. FIG. 7A is an enlarged view showing surroundings of a contacting portion shown in FIG. 6A, and FIG. 7B is a side view corresponding to FIG. 7A. FIG. 8 is a view illustrating how the contacting portion abuts the space adjustment member.

In the description of the present embodiment to follow, the conveying direction of a recording medium will be referred to as the X-direction; a direction perpendicular to the X-direction, as the Y- or width direction; and a direction perpendicular to the X- and Y-directions, as the Z- or vertical direction.

Roughly speaking, an image recording apparatus 10 is composed of a supply section 12, image recording section 14, conveying section 16, elevating section 16, and receiving section 20.

The supply section 12 includes a paper feed tray 32 that contains recording medium 30, a paper feed roller 34, and an alignment roller pair 36.

The paper feed roller 34, contacts each recording medium 30 in the paper feed tray 32 and delivers the medium 30 one after another. Further, the alignment roller pair 36 corrects a tilt (or skew) of the conveyed recording medium 30 with respect to the X-direction.

The alignment roller pair 36 comprises upper and lower alignment rollers 36*a* and 36*b*. Alignment roller 36*b* is located so that its upper surface is flush with an extension of a conveying path for the recording medium 30. Further, alignment roller 36*a* is disposed above alignment roller 36*b*. Alignment roller 36*a* is urged to press the lower alignment roller 36*b* downward by a spring (not shown).

The leading end of the recording medium 30 fed by the paper feed roller 34 is brought into contact with a nip portion of the alignment, roller pair 36. The alignment roller pair 36 first corrects the skew of the recording medium 30 with respect to the X-direction. Thereafter, the roller pair 36 conveys the recording medium 30 downstream in time with image recording by the image recording section 14, which will be described below.

The following is a description of the image recording section 14.

In the present embodiment, the image recording section 14 includes, for example, a head unit 42 (42C, 42K, 42M and 42Y) that ejects inks of four colors (cyan [C], black [B], magenta [M], and yellow [Y]), head holding member 44 that holds the head unit 42, and space adjustment members 46 (46*a* to 46*d*).

As shown in FIGS. 2 to 4, the head holding member 44 is provided with a plurality of openings 48. Recording heads 50 are positioned and fixed in the openings 48, individually. Thus, the head unit 42 of a line type is constructed such that its width is greater than or equal to that of a recording area in which image recording in the width direction of the recording medium 30 is performed.

In the present embodiment, six recording heads are arranged in the Y-direction to form the head unit 42 that is greater than or equal to the recording medium 30 in width. It should be understood that the number of recording heads is not limited to six and the head unit 42 may be composed of a single elongated recording head.

The head unit 42 (42C to 42Y) ejects inks of the various colors supplied individually from ink supply systems (not shown) onto the recording medium 30, thereby forming an image. Further, the space adjustment members 46 are disposed on an opposite surface 44*a* of the head holding member 44 that is opposed to the conveying section 16, which will be described later. More specifically, space adjustment members 46*a* and 46*c* are arranged upstream of the opposite surface 44*a* with respect to the conveying direction, and space adjustment members 46*b* and 46*d* are arranged downstream; of the opposite surface 44*a* with respect to the conveying direction. The space adjustment members 46 and contacting portions (to be described later) jointly constitute positioning sections.

The space adjustment member 46 (46*a* to 46*d*) is, for example, a pin that projects toward the conveying section 16. The pin has a length such that it slightly projects from a nozzle surface of each recording head 50. In the present embodiment, the distal end of the space adjustment member 46 projects 1 mm from the nozzle surface of the recording head 50. The amount of projection of the space adjustment member 46 from the nozzle surface of the recording head 50 can be varied by means of a projection adjustment member (not shown).

As shown in FIG. 5, moreover, the space adjustment member 46 is provided with a through-hole 52 extending in a Z-direction. A wire 86 (86*a* in FIG. 5, described later) is passed through the through-hole 52.

The following is a description of the conveying section 16.

The conveying section 16 is located downstream of the supply section 12 in the conveying direction and opposed to the image recording section 14. The conveying section 16 is composed of suction fans 62, conveyor belt 64, platen 66, driving roller 68, driven roller 70, tension rollers 72*a* and 72*b*, and conveyor frame 74.

The conveyor belt 64 is formed of an endless belt having a large number of holes in its surface. The belt 64 is held under tension by the driving roller 68, driven roller 70, and tension rollers 72*a* and 72*b*.

The driving roller 63, driven roller 70, and tension rollers 72*a* and 72*b* are held for rotation by the conveyor frame 74. A motor 76 is connected to the driving roller 68. The conveyor belt 64 rotates in a predetermined direction as the motor 76 is driven.

Further, the platen 66 is disposed below the conveyor belt 64. The platen 66 is also held by the conveyor frame 74.

The platen 66 is machined so that at least its region opposed to the image recording section 14 is flat and is formed with a large number of holes. As shown in FIG. 6A, the platen 66 is provided with contacting portions 80*a* to 80*d* corresponding in position to the space adjustment members 46. The respective distal ends of the adjustment members 46 abut the contacting portions 80, thereby setting the space between the image recording section 14 and conveying section 16 to a predetermined value. Thus, the space adjustment members 46 and contacting portions 80 have functions as positioning sections for adjusting the space between the image recording section 14 and conveying section 16.

FIG. 7A is an enlarged view showing contacting portion 80*a*, and FIG. 7B is an enlarged view showing a fixing portion 82*a* located below contacting portion 80*a*.

As shown in FIG. 7A, a notch $\mathbf{80}a_1$ is formed in contacting portion 80*a*. As shown in FIG. 7B, wire 86*a* is passed through notch $\mathbf{80}a_1$. While notch $\mathbf{80}a_1$ is formed in contacting portion 80*a* in the present embodiment, it may be of any shape provided that it enables wire 86*a* to penetrate contacting portion 80*a* (or the platen 66). Further, notches $\mathbf{80}b_1$, $\mathbf{80}c_1$ and $\mathbf{80}d_1$ (not shown) similar to notch $\mathbf{80}a_1$ are formed in contacting portions 80*b* to 80*d*, respectively.

As shown in FIG. 6B, fixing portions 82*a* to 82*d* for fixing the other ends of the wires 86 are disposed below the contacting portions 80. Fixing portions 82*a* to 82*d* are attached to the conveyor frame 74. Fixing portions 82*c* and 82*d* (not shown in FIG. 6B) are disposed below contacting portions 80*c* and 80*d*, respectively.

Since fixing portions 82*b* to 82*d* are constructed in the same manner as fixing portion 82*a*, their description is omitted.

As shown in FIG. 7B, fixing portion 82*a* is disposed on the conveyor frame 74. Fixing portion 82*a* is formed with a notch $\mathbf{82}a_1$ corresponding in position to notch $\mathbf{80}a_1$ of contacting portion 80*a*. The width of notch 82*a* is less than the diameter of a sphere $\mathbf{86}a_1$ on the other end of wire 86*a*. Thus, when the conveying section 16 is raised or lowered by wire 86*a*, notch $\mathbf{82}a_1$ of fixing portion 82*a* serves as a stop for sphere $\mathbf{86}a_1$. Thus, the conveying section 16 can be raised and lowered without disengagement. Specifically, the other end of wire 86*a* is fixed to the conveying section 16 by sphere $\mathbf{86}a_1$ and notch $\mathbf{82}a_1$.

The way of fixing the other end of wire 86*a* is not limited to this method. For example, the other end of wire 86*a* may be fixed directly to the conveyor frame 74 provided that the conveying section 16 can be raised and lowered without disengagement.

Further, the suction fans 62 are located below the platen 66 and held by the conveyor frame 74. The fans 62 draw in air through the numerous holes in the conveyor belt 64 and platen 66. Thus, the recording medium 30 conveyed from the alignment roller pair 36 is drawn onto the conveyor belt 64 and conveyed downstream at a predetermined conveying speed.

The following is a description of the elevating section 18.

The elevating section 18 is a moving mechanism for moving the conveying section 16 between the image recording position and non-recording position. As shown in FIG. 4, the elevating section 18 is composed of four wires 86*a* to 86*d*, a motor 90 for use as a driving source, take-up sections 92 for taking up the wires 86, and a take-up shaft 94 for transmitting the driving force of the motor 90 to the take-up sections 92.

As shown in FIG. 4, the motor 90 is mounted on the head holding member 44 and rotates the take-up shaft 94 that extends in the conveying direction via means of gears (not shown). The shaft 94 is fitted with the four take-up sections 92 for individually taking up wires 86*a* to 86*d*. Each take-up section 92 is composed of a pulley 96 and torque limiter 98. One end of each of the wires 86 is fixed to the pulley 96. The other end of each of the wires 86 is fixed to the conveying section 16. More specifically, wire 86*a*, one end of which is attached to the take-up section 92, passes the through-hole 52 in the space adjustment member 46*a* via a plurality of pulleys, as shown in FIG. 5. The other end of wire 86*a* is fixed to the conveying section 16.

While only wire 86*a* and space adjustment member 46*a* are shown in FIG. 5, wires 86*b* to 86*d* are passed through space adjustment members 46*b* to 46*d*, respectively, and their other ends are fixed to the conveying section 16. As shown in FIG. 4, moreover, wires 86*a* and 86*b* are distributed to the positions of their corresponding space adjustment members 46*a* and 46*b* by means of pulleys. Thus, wires 86*a* to 86*d* suspend the conveying section 16 from the image recording section 14.

When the take-up shaft 94 is rotated in a predetermined direction by the motor 90, in the elevating section 18 constructed in this manner, the take-up sections 92 (each including the pulley 96 and torque limiter 98) rotate correspondingly. Thereupon, wires 86*a* to 86*d* are simultaneously taken up by the pulleys 96. When this is done, the torque limiters 98 serve to prevent the wires 86 from being excessively tensioned. Thus, the wires 86 are prevented from being broken or elongated by an excessive force when they are taken up by the take-up sections 92.

The following is a description of the receiving section 20.

The receiving section 20 is located downstream of the conveying section 16 in the conveying direction. The receiving section 20 includes a paper exit roller pair 102 and a paper receiving tray 104. The exit roller pair 102 serves to discharge the recording medium 30 having undergone image recording from the conveying section 16. The paper receiving tray 104 serves to stock the image-recorded medium 30.

The following is a description of the operation of the image recording apparatus 10.

First, when the image recording apparatus 10 is switched on, the conveying section 16 is retracted to a non-recording position (or retracted position) shown in FIG. 1B. The conveying section 16 is also located in the non-recording position when the head units 42 are cleaned by a cleaning section (not shown) or a paper jam is removed.

Then, the elevating section 18 is driven when an instruction for image recording is input through a control panel (not shown) of the apparatus 10 or an instruction signal for image recording is input from a host apparatus (not shown) that is connected by a signal line. To be more specific, the motor 90 is driven, and the resulting driving force is transmitted to the take-up shaft 94. As a result, the take-up shaft 94 rotates, and wires 86*a* to 86*a* are taken up individually by the take-up sections 92. When this is done, spheres $\mathbf{86}a_1$, $\mathbf{86}b_1$, $\mathbf{86}c_1$ and $\mathbf{86}d_1$ at the other ends of wires 36*a* to 86*d* are fixed by fixing portions 82*a* to 82*d* of the conveying section 16. Thus, the conveying section 16 is raised toward the image recording section 14.

When the conveying section 16 is raised by the elevating section 18, contacting portions 80*a* to 80*d* on the platen 66 of the conveying section 16 abut space adjustment members 46*a* to 46*d*, respectively, on the head holding member 44 of the image recording section 14. FIG. 8 shows details of this state. Although wire 86*a*, space adjustment member 46*a*, contacting portion 80*a*, and fixing portion 82*a* are representatively shown in FIG. 8, wires 86*b* to 86*d*, space adjustment members 46*b* to 46*d*, contacting portions 80*b* to 80*d*, and fixing portions 82*b* to 82*d* are constructed similarly to them, so that a description of these groups is omitted.

Wire 86*a* passes through the through-hole 52 in space adjustment member 46*a*. Specifically, the axial direction of space adjustment member 46*a* is substantially coincident with that of wire 86*a*. Accordingly, the point of application of a force with which contacting portion 80*a* abuts space adjustment member 46*a* can be made substantially coincident with a spot at which adjustment member 46*a* and contacting portion 80*a* contact (or abut) each other. Thus, the ability to deform the conveying section 16 (or platen 66) can be reduced by applying a force to raise the conveying section 16 to space adjustment member 46*a*.

Consequently, the platen 66 can maintain its flatness without being deformed. Further, the space between the image recording section 14 and conveying section 16 can be set to the predetermined value by means of space adjustment members 46*a* to 46*d* and contacting portions 80*a* to 80*d*.

Thus, the conveying section 16 is located in the recording position shown in FIG. 1A.

Thereafter, the paper feed roller 34 is driven after the alignment roller pair 36, driven roller 70, and exit roller pair 102 are driven. Thereupon, the top recording medium 30 is picked up from the paper feed tray 32 by the paper feed roller 34. Then, the recording medium 30 reaches the nip portion that is defined by the respective facing parts of alignment rollers 36*a* and 36*b*.

When this is done, the rotation of alignment rollers 36*a* and 36*b* is temporarily stopped by a resist clutch. Thus, the recording medium 30 conveyed toward the alignment roller pair 36 runs into the nip portion and is arrested thereby, whereupon its conveyed attitude is corrected. In other words, a skew, if any, is corrected.

The inhibition by the resist clutch is removed in a predetermined time, and the alignment roller pair 36 starts to rotate. Thereupon, the recording medium 30 is delivered onto the conveyor belt 64 of the conveying section 16 at a predetermined speed. A sucking force produced by the suction fans 62 acts on the conveyor belt 64 through the numerous holes in the platen 66 and conveyor belt 64.

Therefore, the recording medium 30 delivered onto the conveyor belt 64 by the alignment roller pair 36 is drawn by the sucking force onto the belt 64. As a result, the recording medium 30 on the conveyor belt 64 is conveyed in the X direction at a predetermined conveying speed.

The recording medium 30 passes through an area below each of the head units 42C, 42K, 42M and 42Y. At the time, ink drops are ejected from the head units 42C to 42Y onto the recording medium 30, whereby images are recorded on the medium 30.

The recording medium 30, having the recorded images thereon, is discharged from by the exit roller pair 102 and stored by paper receiving tray 104.

In the present embodiment, as described above, the platen is raised and lowered by means of the wires, which are passed through the space adjustment members for adjusting the space between the head and platen. In this way, the force with which the platen abuts the space adjustment members is applied within a plane on which the platen contacts the adjustment members. According to this arrangement, the force of abutment does not bend the platen, so that the platen cannot be deformed, and therefore, high-quality image recording can be performed.

(First Modification)

Figure 9:
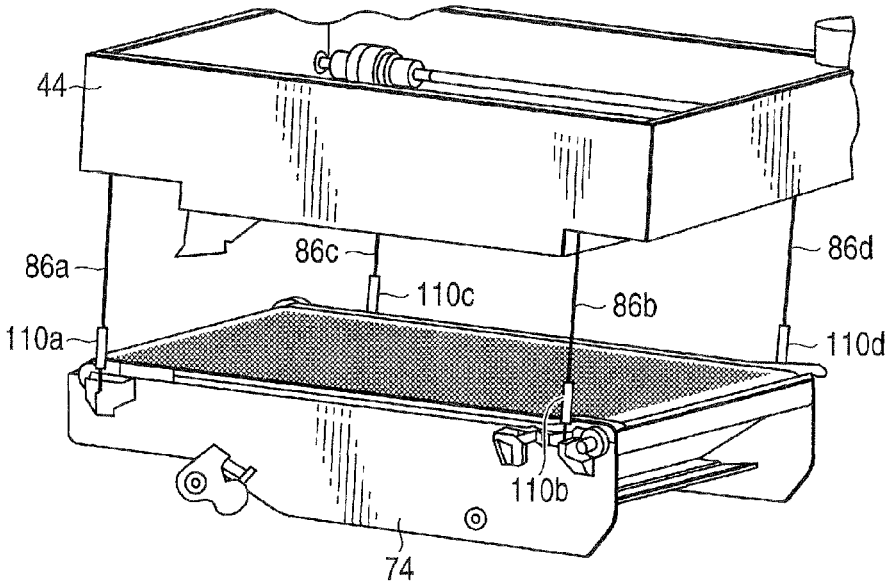
FIG. 9 is a view showing a first modification of the one embodiment of the invention.

Although the head holding member and platen according to the foregoing embodiment are provided with the space adjustment members and contacting portions, respectively, the present invention is not limited to this arrangement. As shown in FIG. 9, for example, a platen may be provided with space adjustment members 110*a*, 110*b*, 110*c* and 110*d*, and the head holding member may be provided with contacting portions (not shown).

(Second Modification)

As shown in FIG. 10, moreover, a space adjustment member 46' may be formed in the shape of a stepped pin, and a contacting portion 80' may be provided with an opening 114 in which the adjustment member 46' can be fitted. Thus, by fitting the adjustment member 46' to the contacting portion 30', positioning can be performed with respect not only to the Z-direction but also to an XY-plane.

(Third Modification)

In connection with the foregoing embodiment, moreover, the head unit has been described as of a line type. Alternatively, however, the head unit may be of a serial type, as shown in FIGS. 11A and 11B.

FIGS. 11A and 11B show general configurations of a head holding member 44 and platen 66 (conveying section) used in combination with a serial-type recording head 120. FIG. 11A is a perspective view showing the platen in its lowered state, and FIG. 11B is a perspective view showing the platen in its raised state.

(Fourth Modification)

Although the wires are used in the elevating section according to the foregoing embodiment, furthermore, the present invention is not limited to this arrangement. For example, ball screws may be used in place of the wires.

Figure 12A:
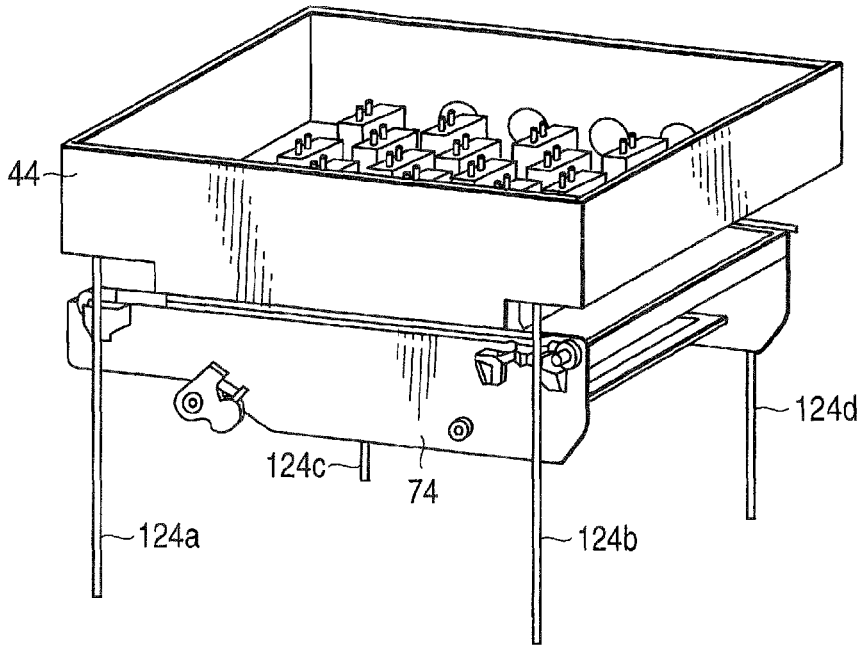
FIGS. 12A and 12B are views showing a fourth modification of the one embodiment of the invention.
Figure 12B:
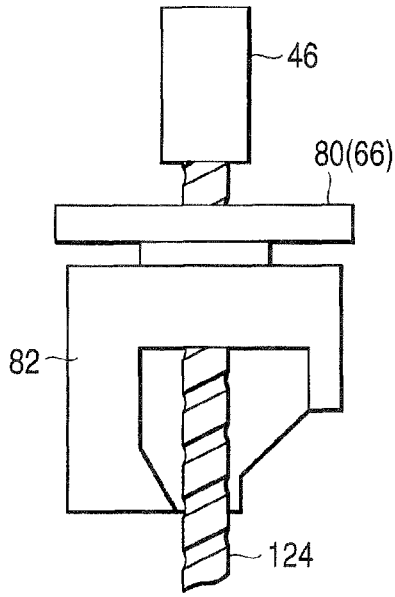

FIG. 12A is a perspective view showing the structures of an image recording section and conveying section. FIG. 12B is a sectional view illustrating how the image recording section and conveying section are positioned with respect to each other.

In this modification, one end of each ball screw 124 is held for rotation by a space adjustment member 46. Specifically, the axial direction of the space adjustment member 46 is substantially coincident with that of the ball screw 124. Grooves (not shown) for threaded engagement with the screw 124 are formed in a fixing portion 82 and contacting portion 80, individually.

When the ball screw 124 is rotated in a predetermined direction, in this arrangement, the contacting portion 80 and fixing portion 82 in threaded engagement with the screw 124, along with a conveying section 16, ascend or descend.

Also in this arrangement, a force of abutment does not act to bend a platen. Therefore, the platen cannot be deformed, and high-quality image recording can be performed.

In this fourth modification, moreover, the conveying section is raised and lowered with respect to the image recording section. Alternatively, however, only the image recording section or both the image recording section and conveying section may be raised and lowered.

Although the one embodiment of the present invention has been described herein, it should be understood that the invention is not limited to the embodiment, and that various changes or modifications may be effected therein without departing from the scope or spirit of the invention.

Further, the embodiment described above includes inventions in various stages, and various inventions can be extracted from an appropriate combination of a plurality of disclosed constituent elements. For example, some of all the constituent elements described in connection with the embodiment may be eliminated without tailing to solve the problem to be solved by the invention. This arrangement can also be extracted as an invention provided that the effects described herein can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus comprising:

a conveying section including a platen which conveys a recording medium;

an image recording section which ejects an ink onto the recording medium conveyed by the conveying section, thereby performing image recording;

a moving mechanism which moves at least one of the image recording section and the conveying section to change a space between the image recording section and the conveying section, and enables a movement between a recording position in which the image recording is performed and a non-recording position in which the image recording is not performed; and a positioning section which permits the space between the image recording section and the conveying section to have a predetermined value at the recording position;

wherein a point of application of a force with which at least one of the image recording section and the conveying section is moved by the moving mechanism is substantially coincident with the positioning section;

wherein the positioning section includes a space adjustment member which adjusts the space between the image recording section and the conveying section, and a contacting portion which contacts or is fitted with the space adjustment member, the space being determined to have the predetermined value when the moving mechanism is operated to cause the contacting portion to contact or be fitted with the space adjustment member; and wherein the space adjustment member has a through-hole therein, and the moving mechanism comprises a wire which passes through the through-hole of the space adjustment member and connects the image recording section and the conveying section.

2. An image recording apparatus comprising:

a conveying section including a platen which conveys a recording medium;

an image recording section which ejects an ink onto the recording medium conveyed by the conveying section, thereby performing image recording;

a moving mechanism which moves at least one of the image recording section and the conveying section to change a space between the image recording section and the conveying section, and enables a movement between a recording position in which the image recording is performed and a non-recording position in which the image recording is not performed; and a positioning section which permits the space between the image recording section and the conveying section to have a predetermined value at the recording position;

wherein a point of application of a force with which at least one of the image recording section and the conveying section is moved by the moving mechanism is substantially coincident with the positioning section;

wherein the positioning section includes a space adjustment member which adjusts the space between the image recording section and the conveying section, and a contacting portion which contacts or is fitted with the space adjustment member, the space being determined to have the predetermined value when the moving mechanism is operated to cause the contacting portion to contact or be fitted with the space adjustment member;

wherein a point of application of a force with which the moving mechanism is operated to cause the contacting portion to contact or be fitted with the space adjustment member is substantially coincident with a spot where the contacting portion contacts or is fitted with the space adjusting member; and wherein the space adjustment member has a through-hole therein, and the moving mechanism comprises a wire which passes through the through-hole of the space adjustment member and connects the image recording section and the conveying section.

3. The image recording apparatus according to claim 2, wherein the space adjustment member comprises a stepped pin, and the contacting portion is formed with an opening to fit with the stepped pin.

4. An image recording apparatus comprising:

a conveying section including a platen which conveys a recording medium;

an image recording section which ejects an ink onto the recording medium conveyed by the conveying section, thereby performing image recording;

a moving mechanism which moves at least one of the image recording section and the conveying section to change a space between the image recording section and the conveying section, and enables a movement between a recording position in which the image recording is performed and a non-recording position in which the image recording is not performed; and a positioning section which permits the space between the image recording section and the conveying section to have a predetermined value at the recording position;

wherein a point of application of a force with which at least one of the image recording section and the conveying section is moved by the moving mechanism is substantially coincident with the positioning section;

wherein the positioning section includes a space adjustment member which adjusts the space between the image recording section and the conveying section, and a contacting portion which contacts or is fitted with the space adjustment member, the space being determined to have the predetermined value when the moving mechanism is operated to cause the contacting portion to contact or be fitted with the space adjustment member;

wherein the image recording section includes a recording head which ejects the ink and a head holding section which holds the recording head, and one of the head holding section and the platen is provided with the space adjustment member, and a remaining one of the head holding section and the platen is provided with the contacting portion;

wherein a point of application of a force with which the moving mechanism is operated to cause the contacting portion to contact or be fitted with the space adjustment member is substantially coincident with a spot where the contacting portion contacts or is fitted with the space adjusting member; and wherein the space adjustment member has a through-hole therein, and the moving mechanism comprises a wire which passes through the through-hole of the space adjustment member and connects the image recording section and the conveying section.

5. An image recording apparatus comprising:

a conveying section including a platen which conveys a recording medium;

an image recording section which ejects an ink onto the recording medium conveyed by the conveying section, thereby performing image recording;

a moving mechanism which moves at least one of the image recording section and the conveying section to change a space between the image recording section and the conveying section, and enables a movement between a recording position in which the image recording is performed and a non-recording position in which the image recording is not performed; and a positioning section which permits the space between the image recording section and the conveying section to have a predetermined value at the recording position;

wherein a point of application of a force with which at least one of the image recording section and the conveying section is moved by the moving mechanism is substantially coincident with the positioning section;

wherein the positioning section includes a space adjustment member which adjusts the space between the image recording section and the conveying section, and a contacting portion which contacts or is fitted with the space adjustment member, the space being determined to have the predetermined value when the moving mechanism is operated to cause the contacting portion to contact or be fitted with the space adjustment member;

wherein a point of application of a force with which the moving mechanism is operated to cause the contacting portion to contact or be fitted with the space adjustment member is substantially coincident with a spot where the contacting portion contacts or is fitted with the space adjusting member;

wherein the moving mechanism comprises a ball screw which extends coaxially with the space adjustment member and connects the image recording section and the conveying section; and wherein the space adjustment member comprises a stepped pin, and the contacting portion is formed with an opening to fit with the stepped pin.

6. An image recording apparatus comprising:

a conveying section including a platen which conveys a recording medium;

an image recording section including a line-type head unit which ejects an ink onto the recording medium conveyed by the conveying section, thereby performing image recording, and a head holding section which holds the head unit;

a moving mechanism which moves at least one of the image recording section and the conveying section to change the space between the image recording section and the conveying section, and enables a movement between a recording position in which the image recording is performed and a non-recording position in which the image recording is not performed; and a positioning section including (i) a space adjustment member which is provided for one of the head holding section and the platen and adjusts the space between the image recording section and the conveying section, and (ii) a contacting portion which is provided for a remaining one of the head holding section and the platen and permits the space between the image recording section and the conveying section to have a predetermined value at the recording position, wherein a point of application of a force with which the moving mechanism is operated to cause the contacting portion to contact or be fitted with the space adjustment member is substantially coincident with a spot where the contacting portion contacts or is fitted with the space adjusting member, wherein the space adjustment member has a through-hole therein, and the moving mechanism comprises a wire which passes through the through-hole of the space adjustment member and connects the image recording section and the conveying section.

7. The image recording apparatus according to claim 6, wherein the space adjustment member comprises a stepped pin, and the contacting portion is formed with an opening to fit the stepped pin.

* * * * *